US011767152B2

(12) United States Patent
Morris, III et al.

(10) Patent No.: US 11,767,152 B2
(45) Date of Patent: Sep. 26, 2023

(54) RE-SEALING VACUUM PACKAGE RECEPTACLE

(71) Applicant: IV Thought Product & Design, Corp., Buffalo, NY (US)

(72) Inventors: Samuel L. Morris, III, Buffalo, NY (US); Andy Kottage, Columbia, SC (US)

(73) Assignee: IV THOUGHT PRODUCTS AND DESIGN CORP., Buffalo, NY (US)

( * ) Notice: Subject to any disclaimer, the term of this patent is extended or adjusted under 35 U.S.C. 154(b) by 0 days.

(21) Appl. No.: 17/825,154

(22) Filed: May 26, 2022

(65) Prior Publication Data

US 2022/0411161 A1 Dec. 29, 2022

Related U.S. Application Data

(60) Provisional application No. 63/216,020, filed on Jun. 29, 2021.

(51) Int. Cl.

| | |
|---|---|
| ***B65D 81/20*** | (2006.01) |
| ***B65D 43/02*** | (2006.01) |
| ***B65D 51/18*** | (2006.01) |
| ***B65D 53/02*** | (2006.01) |
| ***B65D 51/14*** | (2006.01) |

(52) U.S. Cl.

CPC ..... *B65D 81/2038* (2013.01); *B65D 43/0231* (2013.01); *B65D 51/145* (2013.01); *B65D 51/18* (2013.01); *B65D 53/02* (2013.01); *B65D 2251/0093* (2013.01); *B65D 2543/00092* (2013.01); *B65D 2543/00972* (2013.01)

(58) Field of Classification Search

CPC ..... B65D 81/2038; B65D 43/0231; B65D 51/18; B65D 53/02; B65D 2543/00092; B65D 81/2015; B65D 51/145

USPC ..... 215/220, 262, 276, 349–351; 220/231

See application file for complete search history.

(56) References Cited

U.S. PATENT DOCUMENTS

| | | | |
|---|---|---|---|
| 253,075 | A | 1/1882 | Lyon |
| 986,847 | A | 3/1911 | Nair et al. |
| 1,596,367 | A | 8/1926 | Miller |
| 1,598,870 | A | 9/1926 | Merry |
| 1,687,887 | A | 10/1928 | Pletcher |
| 1,691,276 | A | 11/1928 | Freundt |
| 1,696,388 | A | 12/1928 | Curtis |
| 1,765,383 | A | 6/1930 | Punte |
| 2,004,964 | A | 6/1935 | Behr et al. |
| 2,112,231 | A | 3/1938 | Speidel et al. |
| 2,128,959 | A | 9/1938 | Nicholls |

(Continued)

*Primary Examiner* — James N Smalley

(74) *Attorney, Agent, or Firm* — ROACH, BROWN, MCCARTHY & GRUBER, P.C.; Kevin D. McCarthy

(57) ABSTRACT

A resealable, vacuum packable receptacle has a container, a sealing layer, an inner lid, and an outer lid. When (i) the outer lid opening receives the inner lid, (ii) the inner lid is threadably mated with the container, and (iii) the container has the sealing layer positioned over the container's mouth; (A) a portion of the outer lid causes the outer lid or the inner lid to contact the sealing layer to push a desired amount of air from the container which then results in inhibiting air from entering or exiting the container, or (B) the distance between the outer lid's top surface and the inner lid's top surface can be altered, and when the distance is increased, the air pressure in the container is decreased.

18 Claims, 15 Drawing Sheets

(56) References Cited

U.S. PATENT DOCUMENTS 2,303,205 A 11/1942 Franenberg
2,349,587 A 5/1944 Brand
2,384,810 A 9/1945 Calleson
2,409,788 A 10/1946 Osborne
2,419,616 A 4/1947 White
2,426,550 A 8/1947 Coyle
2,430,036 A 11/1947 Thornburgh et al.
2,449,014 A * 9/1948 Shaffer ..... B65D 51/145 215/276
2,559,658 A 7/1951 Pottle
2,582,489 A * 1/1952 Krueger ..... B65D 51/1683 215/322
2,602,565 A 7/1952 Regan
2,661,862 A 12/1953 Howe
2,661,863 A 12/1953 Howe
2,997,199 A 8/1961 Reachi
3,026,507 A 3/1962 Gaggini
3,029,507 A 4/1962 Gaggini
3,176,872 A 4/1965 Zundel
3,191,564 A 6/1965 Fraze
3,225,957 A 12/1965 Huth
3,255,917 A 6/1966 Fraze
3,303,960 A 2/1967 Fraze
3,349,949 A 10/1967 Brown
3,361,291 A 1/1968 Fraze
3,439,640 A 4/1969 Fraze
3,439,833 A 4/1969 Fraze
3,446,389 A 5/1969 Brown
3,480,175 A 11/1969 Khoury
3,638,597 A 2/1972 Brown
3,643,833 A 2/1972 Fraze et al.
3,726,432 A 4/1973 Gentile
3,752,353 A 8/1973 Slade
3,795,342 A 3/1974 Ashton
3,844,443 A 10/1974 Cudzik
3,856,184 A 12/1974 Luviano
3,871,314 A 3/1975 Stargell
3,877,604 A 4/1975 Brown
3,880,318 A 4/1975 Fraze
3,910,453 A 10/1975 Kneusel et al.
3,924,777 A 12/1975 Peyser
3,938,693 A 2/1976 Patel et al.
3,952,911 A 4/1976 Bozek et al.
3,967,752 A 7/1976 Cudzik
4,007,848 A 2/1977 Snyder
4,042,144 A 8/1977 Henning et al.
4,065,025 A 12/1977 Potts
4,078,695 A 3/1978 Potts
4,116,360 A 9/1978 McKernan et al.
4,116,361 A 9/1978 Stargell
4,122,964 A * 10/1978 Morris ..... B65D 51/145 215/276
4,122,971 A 10/1978 Potts
4,165,813 A * 8/1979 Babiol ..... B65D 50/041 215/220
4,172,532 A 10/1979 Palsson
4,182,460 A 1/1980 Holk et al.
4,262,815 A 4/1981 Klein
4,286,633 A * 9/1981 Herr ..... B01L 3/0282 422/934
4,286,728 A 9/1981 Fraze et al.
4,319,690 A * 3/1982 Birrell ..... B65D 50/041 215/220
4,386,713 A 6/1983 Baumeyer et al.
4,399,925 A 8/1983 Fundom
D273,846 S 5/1984 Fraze
4,476,987 A 10/1984 Nolan
D277,826 S 3/1985 Brown
4,567,746 A 2/1986 Bachmann et al.
4,574,975 A 3/1986 Taylor et al.
4,616,761 A * 10/1986 Nolan ..... B65D 41/0442 215/271
4,685,849 A 8/1987 LaBarge et al.
4,705,186 A 11/1987 Barrash
4,711,611 A 12/1987 Bachmann et al.
4,723,687 A 2/1988 Kutterer
4,793,510 A 12/1988 Arfert et al.
4,821,912 A 4/1989 Wells
RE32,927 E 5/1989 Taylor et al.
4,865,215 A 9/1989 Wells
4,872,597 A 10/1989 Hanafusa
4,928,244 A 5/1990 Vermesse
4,928,844 A 5/1990 LaBarge
4,982,862 A 1/1991 La Barge
5,052,576 A 10/1991 Budenbender
5,121,851 A 6/1992 Lyon et al.
D337,521 S 7/1993 McNulty
D338,621 S 8/1993 Balson
5,242,069 A * 9/1993 Hertrampf ..... B65D 51/1661 215/270
5,248,053 A 9/1993 Lundgren
5,292,025 A 3/1994 Dubreul
5,293,765 A 3/1994 Nussbaum-Pogacnik
5,316,161 A * 5/1994 Gargione ..... B65D 50/041 215/220
D348,137 S 6/1994 Campbell
5,356,030 A 10/1994 Budenbender
D355,735 S 2/1995 Shaffer et al.
5,421,480 A 6/1995 Cudzik
5,443,175 A 8/1995 Kelly et al.
5,511,920 A 4/1996 Artrip
5,529,202 A 6/1996 Shamis
D387,987 S 12/1997 Neiner
5,692,633 A 12/1997 Gordon
5,711,447 A 1/1998 Plester
5,713,235 A 2/1998 Diekhoff
5,718,352 A 2/1998 Diekhoff et al.
5,778,723 A 7/1998 Diekhoff
5,779,086 A 7/1998 Barrash
5,785,198 A 7/1998 Credle
D397,062 S 8/1998 Hollington
5,799,775 A 9/1998 Spring
5,816,428 A 10/1998 Plester
5,822,843 A 10/1998 Diekhoff et al.
5,947,315 A 9/1999 Valyi et al.
5,947,318 A 9/1999 Palm
5,975,322 A 11/1999 Reid
6,010,026 A 1/2000 Diekhoff et al.
6,010,028 A 1/2000 Jordan et al.
6,082,944 A 7/2000 Bachmann et al.
6,105,807 A 8/2000 McCrossen
D434,983 S 12/2000 Hurst
6,206,222 B1 3/2001 Cudzik
6,216,904 B1 4/2001 Cagan
6,234,338 B1 5/2001 Searle
D452,155 S 12/2001 Stodd
6,330,954 B1 12/2001 Turner
6,332,551 B1 12/2001 Copeland
6,450,358 B1 9/2002 Berro
6,460,723 B2 10/2002 Nguyen et al.
D470,050 S 2/2003 Renz et al.
6,575,325 B2 6/2003 Dickie et al.
6,609,634 B2 8/2003 De Laforcade et al.
6,626,314 B1 9/2003 McHenry et al.
6,651,833 B2 11/2003 Sciarini
6,722,513 B1 * 4/2004 Flood ..... A61J 11/04 215/276
6,739,471 B2 5/2004 Goetz et al.
6,779,677 B2 8/2004 Chupak
6,877,941 B2 4/2005 Brifcani et al.
6,889,862 B2 5/2005 Vaughan
6,910,598 B2 6/2005 Gotz et al.
7,014,060 B2 3/2006 Richardson
D518,885 S 4/2006 Stout et al.
D525,127 S 7/2006 Cogley et al.
D559,680 S 1/2008 Jacober et al.
7,500,577 B2 3/2009 Wichelhaus
7,743,635 B2 6/2010 Jentzsch et al.
7,823,740 B2 11/2010 Perra
7,841,222 B2 11/2010 Cook et al.
7,891,517 B2 2/2011 Simmons
7,918,359 B2 4/2011 Paris et al.
7,918,363 B2 4/2011 Morabito et al.

(56) References Cited

U.S. PATENT DOCUMENTS

| | | | |
|---|---|---|---|
| D641,622 | S | 7/2011 | Fields |
| D647,400 | S | 10/2011 | Fields |
| 8,215,513 | B1 | 7/2012 | Grissom |
| 8,328,041 | B2 | 12/2012 | Brifcani et al. |
| 8,336,726 | B2 | 12/2012 | Ramsey et al. |
| 8,336,728 | B2 | 12/2012 | Forrest et al. |
| D681,176 | S | 4/2013 | Chacko |
| 8,534,490 | B2 | 9/2013 | Chapin |
| 8,556,106 | B1 | 10/2013 | Bayat et al. |
| D696,113 | S | 12/2013 | Stein |
| 8,608,007 | B2 | 12/2013 | Seo |
| 8,720,717 | B2 | 5/2014 | Kaanta et al. |
| D706,908 | S | 6/2014 | Knapp |
| 8,844,761 | B2 | 9/2014 | Zabaleta et al. |
| 8,939,311 | B2 | 1/2015 | Christopoulos |
| 8,985,371 | B2 | 3/2015 | Zabaleta et al. |
| D728,757 | S | 5/2015 | Graham |
| D730,734 | S | 6/2015 | Rapparini |
| 9,145,239 | B2 | 9/2015 | Wohlgenannt |
| 9,162,796 | B2 | 10/2015 | Bratsch |
| 9,272,819 | B1 | 3/2016 | Zabaleta et al. |
| 9,637,269 | B1 | 5/2017 | Zabaleta et al. |
| 10,427,832 | B1 | 10/2019 | Zabaleta et al. |
| 10,968,010 | B1 | 4/2021 | Zabaleta et al. |
| 2001/0040167 | A1 | 11/2001 | Flecheux et al. |
| 2002/0030053 | A1 | 3/2002 | Copeland |
| 2007/0017891 | A1* | 1/2007 | Herr ..... B65D 55/022 215/349 |
| 2014/0238994 | A1 | 8/2014 | Christopoulos et al. |
| 2015/0190003 | A1 | 7/2015 | Kelaher |
| 2016/0016700 | A1 | 1/2016 | Stevens |
| 2018/0134458 | A1* | 5/2018 | Lloyd ..... B65D 41/0407 |

* cited by examiner

RE-SEALING VACUUM PACKAGE RECEPTACLE

PRIORITY CLAIM

This application claims priority to U.S. provisional patent application Ser. No. 63/216,020 that was filed on Jun. 29, 2021.

TECHNICAL FIELD

The present invention relates generally to a closure structure for containers.

BACKGROUND

Containers for pharmaceutical products are very important in view of (a) environmental protection issues, (b) protection from being damaged and (c) child-resistant protection issues. Containers with particularly hazardous materials, such a pharmaceutical products that are in pill form, liquid form, colloidal form or combinations thereof, are vulnerable to access by children which can lead to harm to the child if the child (i) is able to open the container and (ii) consumes the contents.

Likewise, containers for food and pharmaceutical products are sometimes sealed. Vacuum packing is a method of packing that removes air from the package prior to sealing. This method involves (manually or automatically) placing items in a plastic film package, removing air from inside and sealing the package. Shrink film is sometimes used to have a tight fit to the contents. There are three main types of films used in shrink wrapping: polyvinyl chloride, polyolefin, and polyethylene. Each of these materials features different capabilities and characteristics that make them suitable for specific applications that are known to those skilled in the art. In addition, each material can be co-extruded into multilayer films with different additives in order to create distinct barrier properties that promote shelf life or a particular appearance. The intent of vacuum packing is usually to remove or at least decrease oxygen from the container to extend the shelf life of foods and, with flexible package forms, to reduce the volume of the contents and package.

Vacuum packing reduces atmospheric oxygen, limiting the growth of aerobic bacteria or fungi, and preventing the evaporation of volatile components. It is also commonly used to store dry foods over a long period of time, such as cereals, nuts, cured meats, cheese, smoked fish, coffee, and potato chips. On a more short-term basis, vacuum packing can also be used to store fresh foods, such as vegetables, meats, and liquids, because it inhibits bacterial growth.

Vacuum packing greatly reduces the bulk of non-food items. For example, clothing and bedding can be stored in bags evacuated with a domestic vacuum cleaner or a dedicated vacuum sealer. This technique is sometimes used to compact household waste, for example where a charge is made for each full bag collected.

Vacuum packaging products, using plastic bags, canisters, bottles, or mason jars are available for home use.

The Mason jar—patented it in 1858—is a molded glass jar to preserve food. The jars mouth has a screw thread on its outer perimeter to accept a metal ring or "band". The band, when screwed down, presses a separate stamped steel disc-shaped lid against the jar's rim. An integral rubber ring on the underside of the stamped steel disc-shaped lid creates a hermetic seal. The bands and lids usually come with new jars, but they are also sold separately. While the bands are reusable, the stamped steel disc-shaped lids are intended for single-use when canning since re-sealing the lids under a vacuum seal is difficult.

The current invention solves that problem.

SUMMARY OF THE INVENTION

A resealable, vacuum packable receptacle has a container, a sealing layer, an inner lid, and an outer lid. When (i) the outer lid opening receives the inner lid, (ii) the inner lid is threadably mated with the container, and (iii) the container has the sealing layer positioned over the container's mouth; (A) a portion of the outer lid causes the outer lid or the inner lid to contact the sealing layer to push a desired amount of air from the container which then results in inhibiting air from entering or exiting the container, or (B) the distance between the outer lid's top surface and the inner lid's top surface can be altered, and when the distance is increased, the air pressure in the container is decreased.

DESCRIPTION OF THE INVENTION

A storage device or alternatively referred to as a resealable, vacuum package receptacle 5 for food and pharmaceutical products that are in a liquid state, a solid state like a pill, a colloidal state or combinations thereof is the present invention. The storage device 5 is able to be vacuum packaged numerous times by anyone or anything. Preferably that anyone or anything can be, for example and not limited to, a product manufacturer, a distributor, a consumer, or combinations thereof. An interesting feature of this storage device 5 is that at least one component or combination of components creates a vacuum pop sound when the storage device 5 is opened and re-opened. That means, the food and pharmaceutical products stored in the storage device 5 should be able to be re-vacuum packed by a consumer after the storage device 5 has been opened. In other words, the storage device 5 is able (i) to be vacuum packed, (ii) opened with a vacuum pop sound, (iii) re-vacuum packed, and then (iii) opened again with another vacuum pop sound. Moreover, the storage device 5, in some embodiments, could be able to indicate or illustrate when the storage device is vacuum packed or not.

Figure 1:
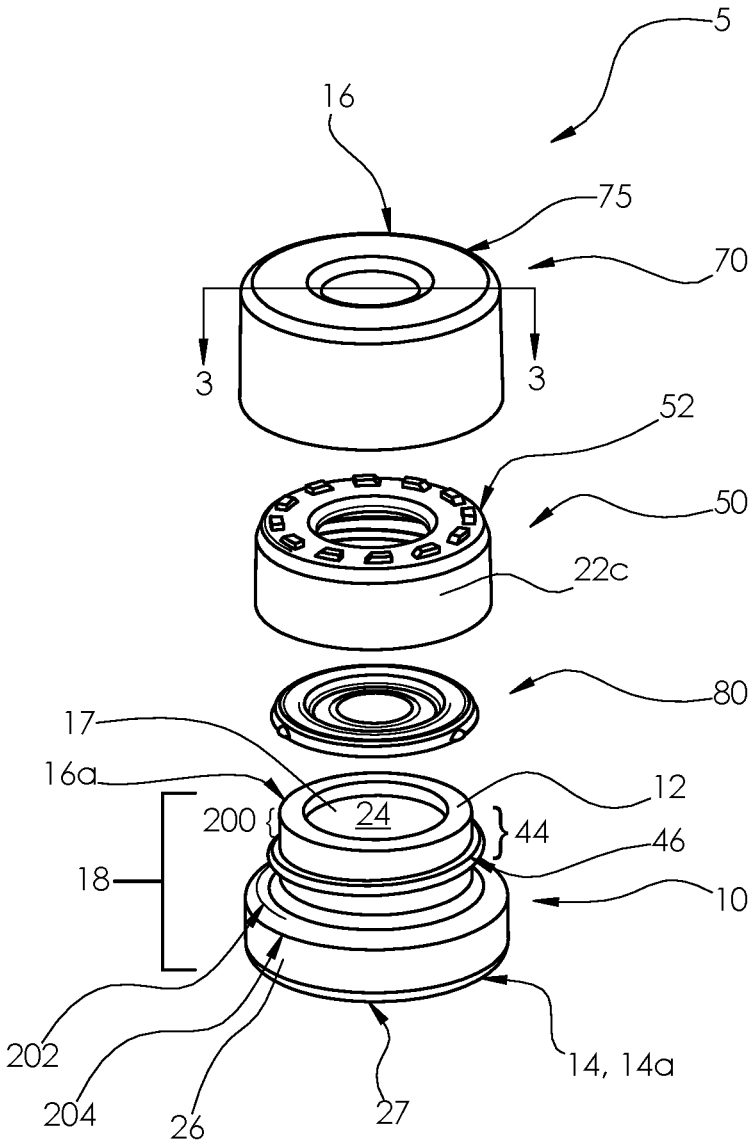
FIG. 1 illustrates an exploded view of a resealable, lower air pressure receptacle having a container, a sealing layer, an inner lid, and an outer lid.

The storage device 5 has, as illustrated at FIG. 1, a container 10, a sealing layer 80, an inner lid 50 and an outer lid 70. The container 10 illustrated at FIG. 1 has a cylindrical shape. That said, the container 10 can have any shape configuration—cylindrical, cubic, cuboidal, rectangular prism, spherical, conical, polygonic prism (see FIG. 2), polygonic pyramid, or combinations thereof—so long as the container mouth 12 and a corresponding threaded portion 44 define a cylindrical shape area for the container 10 that is positioned at and near the container's distal end 16*a*.

In each shape configuration, the storage device 5 has a proximal end 14 and a distal end 16, the container 10 has a proximal end 14*a* and a distal end 16*a*, the sealing layer 80 has a proximal end 14*b* and a distal end 16*b* (see, FIG. 3), the inner lid 50 has a proximal end 14*c* and a distal end 16*c* and the outer lid 70 has a proximal end 14*d* and a distal end 16*d*. In the container 10, the container proximal end 14*a* is a base surface 27 that is also referred to as a closed end; the container distal end 16*a* includes the container mouth 12 that defines a container opening 17 at the distal end 16*a*; and between the container proximal end 14*a* and the container distal end 16*a* is at least one side barrier 18 as illustrated when the container 10 is cylindrical. Collectively, the side barrier 18 and the floor section 27 are referred to as a container wall 26. In each configuration, the container 10 has a container exterior surface 20 (see, FIG. 2) exposed to an ambient environment and a container interior surface 22 that defines a chamber 24 in the container 10. Normally, the separation between the exterior surface 20 and the interior surface 22 is normally a distance 19 if, for example, the wall 26 has (a) essentially a uniform width (excluding thread(s) 46) (see, FIG. 4, wall 26*b* as an example) or (b) multiple distances if the wall 26 has varied widths as illustrated at FIG. 3.

Figure 4:
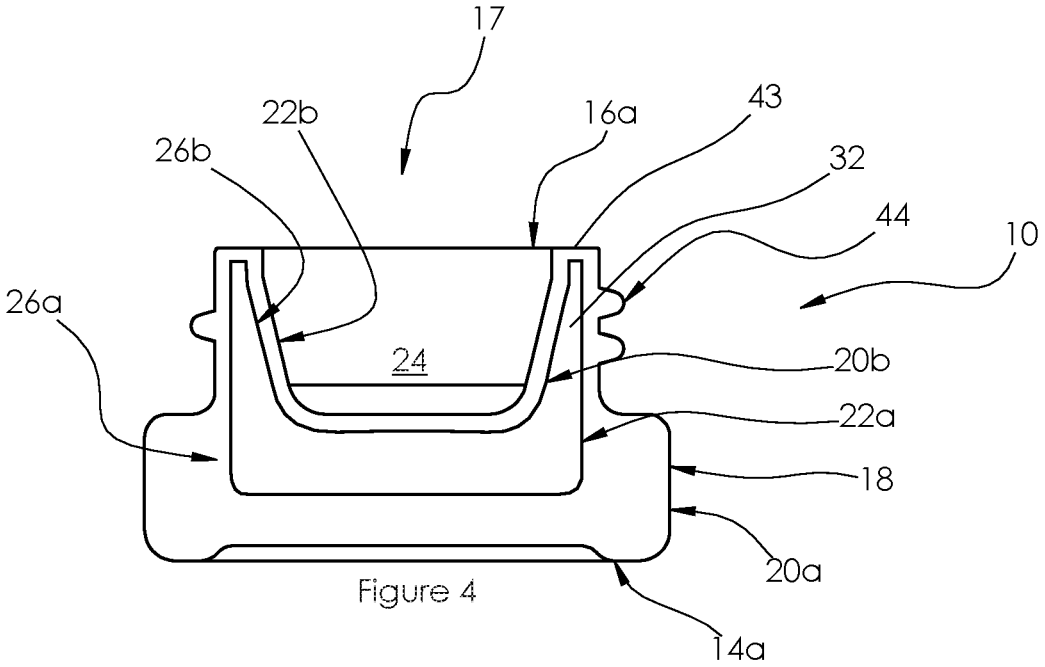
FIG. 4 illustrates an alternative cross-sectional view of FIG. 1's container that is also applicable to construction of the inner lid and the outer lid.

Alternatively as shown at FIG. 4, the container 10 could also contain at least a first wall 26*a* having an exterior surface 20*a* exposed to an ambient environment and a second wall 26*b* having an interior surface 22*b* that defines the container cavity 24 in the container 10; while the first wall's interior surface 22*a* and the second wall's exterior surface 24*b* are connected together at the distal end 16*a* by a joinder surface 43 and are spaced apart everywhere else to create an insulation and/or gap area 32 that can be filled with air, a vacuum area, a vacuum area lined with metal, like copper; and/or conventional insulation material for example and not limited to polymeric foam to maintain the cavity 24 at a desirable temperature zone—ambient, warm, or cool.

When any container embodiment is used, the container opening 17 defines the cavity's distal end. The chamber 24 is capable and designed to (a) receive and contain food and/or pharmaceutical products for example, a solid material(s) like pills or meat, a liquid(s), a colloid(s), or combinations thereof, and permit those products to be removed and/or poured therefrom; and (b) have a desired volume for the desired food and/or pharmaceutical products. It is understood the container 10 has the base surface 27 at the container proximal end 14*a*, and at least one side surface 18 extending upward from the base surface 27 toward the container distal end 16*a* that collectively form the container exterior surface 20 and can define the container interior surface 22. The container exterior surface 20 and the container interior surface 22 are spaced apart by (a) the material or materials that forms the base surface 27 and the at least one side surface 18, thus there is no air gap between the surfaces 20, 22; (b) by at least one insulation/gap area 32 between the container exterior surface 20 and the container interior surface 22 that can be a vacuum environment or filled with insulation, air or combinations thereof and wherein the container exterior surface 20 and the container interior surface 22 are normally joined together by the joinder surface 43 that may form at least a portion of the mouth 12 at the container distal end 16*a*, or (c) combinations thereof. The joinder surface 43 can be made of the same or different material or materials that forms the base surface 27 and the at least one side surface 18. The materials that form the container 10 are selected from the group consisting of polymeric material, metallic material, and combinations thereof with the understanding that the material used must not contaminate the product contained in the chamber 24. The mouth 12 is positioned at the container distal end 16*a* and the distal end of the at last one side wall 18 and the mouth 12 defines an opening 17 of a chamber 24 that is defined by the container interior surface 22. The chamber 24 is capable of receiving air and/or at least one object. That object can be, for example, a food or a pharmaceutical product that is in a solid state, a liquid state, a colloidal state, or combinations thereof. The container 10 also has a threaded exterior surface area 44 having threads 46 on the container exterior surface 20.

As previously expressed, the container's proximal end 14*a* is the closed end 27, and the closed end 27 and the side barrier(s) 18 define the chamber 24 and the only way that any product enters or leaves the chamber 24 is through the opening 17.

Figure 2:
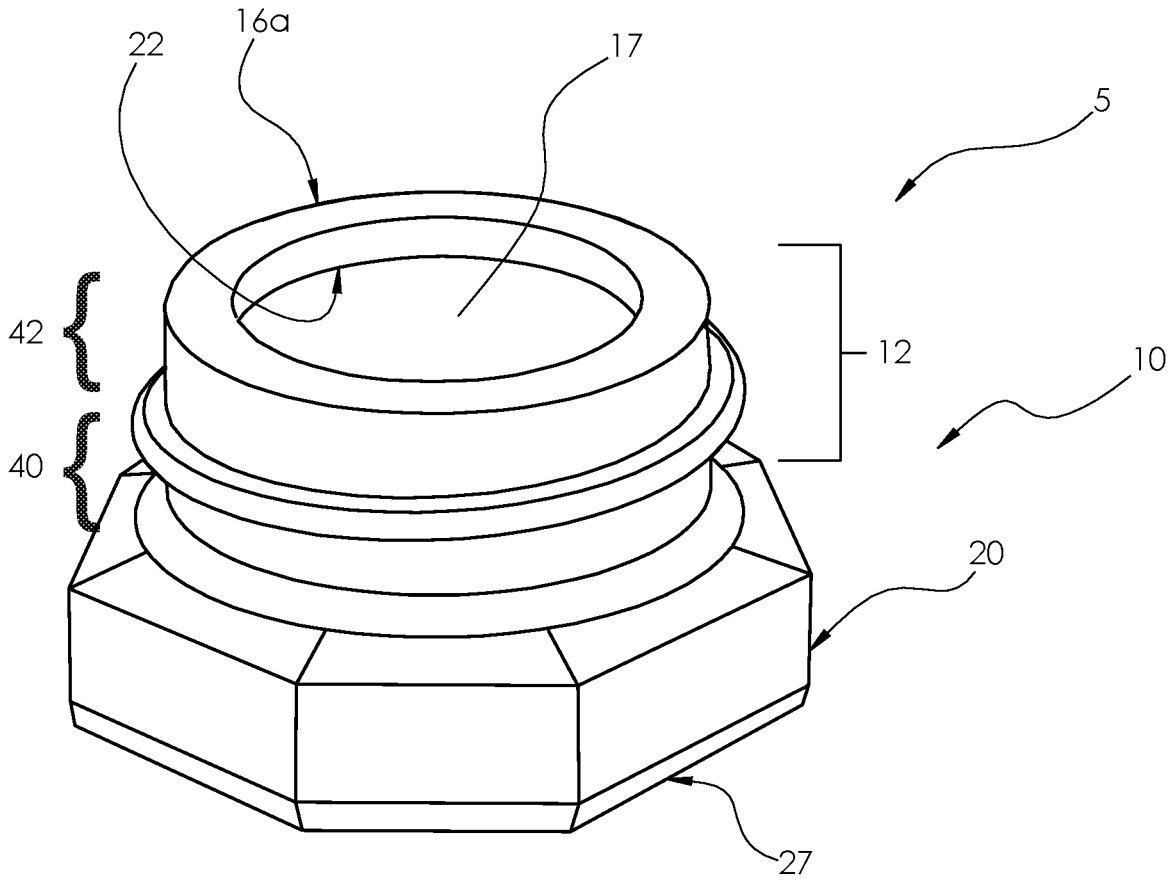
FIG. 2 illustrates an alternative version of the resealable, lower air pressure receptacle wherein a portion of the container is non-cylindrical.
Figure 3:
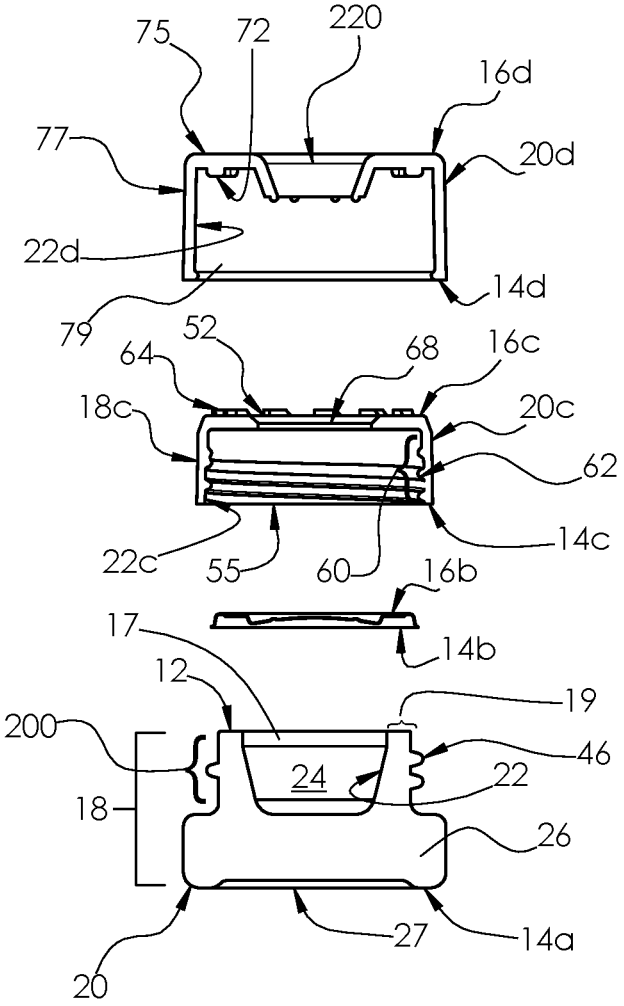
FIG. 3 illustrates a cross-sectional view of FIG. 1 taken along the lines 3-3.

As illustrated at FIGS. 1 and 2, the container 10 can have an inner lid receiving area 200 positioned immediately below the mouth 12. The inner lid receiving area 200 can have a ledge 202, at the inner lid receiving area's proximal end in order for the inner lid's 50 proximal end 14*c* to contact or come in close contact with the ledge 202 when the inner lid is properly attached to the container 10, and has at least a threaded portion 44 having threads 46 thereon positioned between the mouth 12 and the ledge 202. Excluding the threads 46 on the threaded portion 44, the threaded portion 44 has a diameter less than the perimeter or diameter of the outer edge 204 of the ledge 202.

The threaded portion 44 is designed to engage with the child resistant insert or inner lid 50. The inner lid 50 has an inner lid top surface 52 at or near the inner lid's distal end 16*c*, an inner lid exterior surface 20*c*, an inner lid interior surface 22*c*, and an inner lid side surface 18*c* wherein the inner lid side surface 18*c* with the inner lid interior surface 22*c* define an inner lid opening 55, and the inner lid opening 55 is positioned at the inner lid proximal end 14*c*. The inner lid interior surface 22*c* and the inner lid exterior surface 20*c* are spaced apart by (a) the material or materials that forms the inner lid exterior surface 20*c*, thus there is no insulation/gap area between the surfaces 20*c*, 22*c*; (b) by at least one insulation/gap area between the inner lid exterior surface 20*c* and the inner lid interior surface 22*c* that can be a vacuum environment, filled with insulation or air or combinations thereof and wherein the inner lid exterior surface 20*c* and the inner lid interior surface 22*c* are normally joined together by an inner lid joinder surface to form at the inner lid proximal end 14*c*, or (c) combinations thereof. The inner lid joinder surface can be made of the same or different material or materials that forms the inner lid exterior surface 20*c* and the inner lid interior surface 22*c*. The materials that form the inner lid 50 are selected from the group consisting of polymeric material, metallic material, and combinations thereof with the understanding that the material used must not contaminate the product contained in the chamber 24. In one embodiment, the inner lid 50 has (a) a center aperture 68 on the inner lid top surface 52 wherein the center aperture 68 extends from the inner lid's exterior surface 20*c* to the inner lid's interior surface 22*c*; (b) a threaded section 60 having threads 62 on the inner lid's interior side surface 22*c*, 18*c*, wherein the inner lid's threaded section 60 is capable of threadably mating with and/or being removably attached from the container's threaded exterior surface area 44, and (c) at least one locking protrusion or lug 64 extending upward from the top surface's exterior surface 52, 20*c*.

Positioned between the container 10 and the inner lid 50 is the sealing layer 80. The sealing layer 80 is capable of being positioned over the mouth 12 and the chamber 24. The sealing layer distal end 16*b* is able to contact the inner lid top surface, interior surface 22*c*, while the sealing layer proximal end 14*b* is able to contact the mouth 12, which can include the joinder surface 43. The sealing layer 80 can be a permanent part of the inner lid 50, a removable and replaceable part of the inner lid 50, an independent part of the inner lid 50 and the container 10, or combinations thereof.

Figure 8:
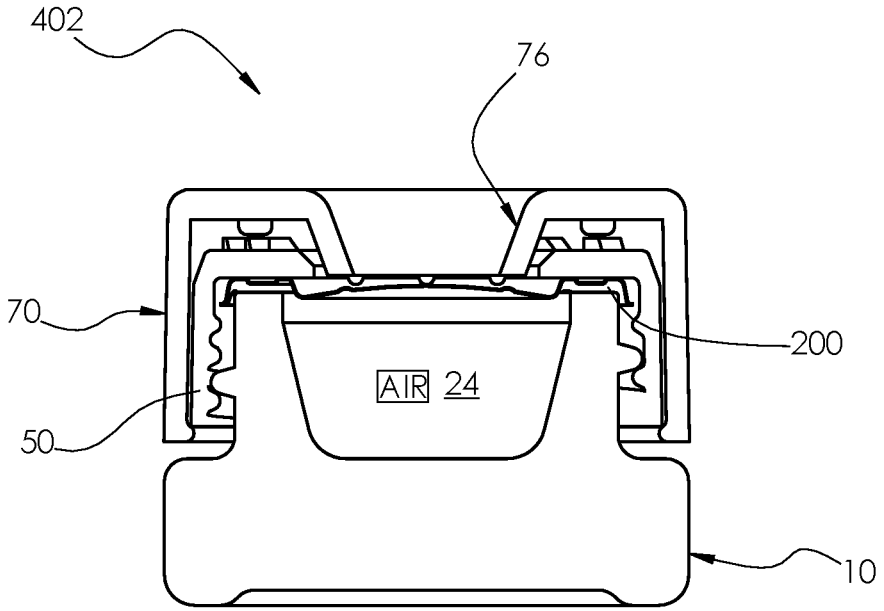
FIG. 8 illustrates a non-compressed state of the resealable, lower air pressure receptacle.
Figure 9:
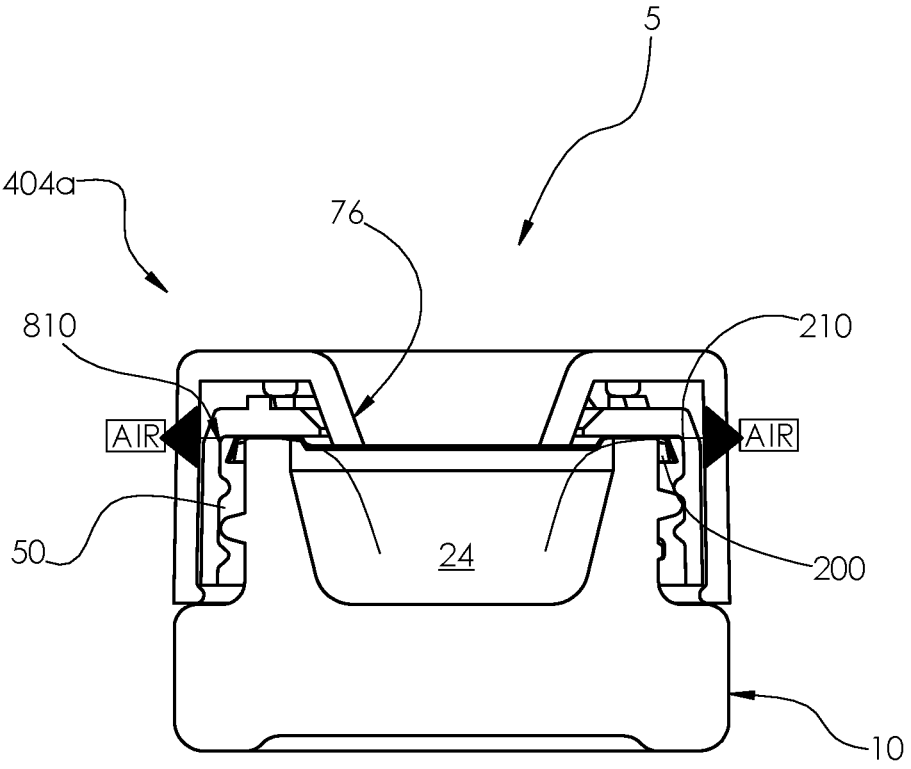
FIG. 9 illustrates an almost compressed state of the resealable, lower air pressure receptacle.
Figure 10:
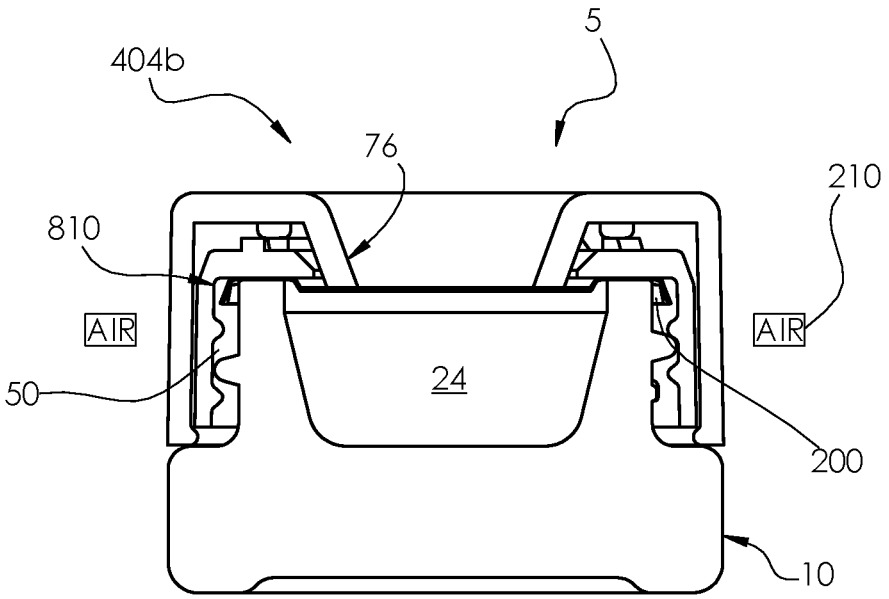
FIG. 10 illustrates a compressed state of the resealable, lower air pressure receptacle.

The sealing layer 80 can be a gasket, a gasket and a seal, or a seal. The materials that form the sealing layer 80 are selected from the group consisting of polymeric material, metallic material, and combinations thereof with the understanding that the material used must not contaminate the product contained in the chamber 24. It is understood that the sealing layer 80 positioned between the inner lid 50 and the container 10 can have a sealable opening 82 that (a) capable of being open which permits air to escape from the chamber 24 when the resealable, lower air pressure receptacle 5 is (i) in a non-compressed state as shown in FIG. 8 wherein the sealing layer 80 can have a concave shape; and (ii) converting toward a compressed state as shown at FIG. 9 wherein the sealing layer 80 appears to have a planar shape; and (b) capable of being closed which inhibits air from entering or exiting the chamber 24 when the resealable, lower air pressure receptacle 5 is in the compressed state as shown at FIG. 10. As illustrated in the compressed state, the sealing layer 80 forms a convex shape over the chamber 24.

Figure 5A:
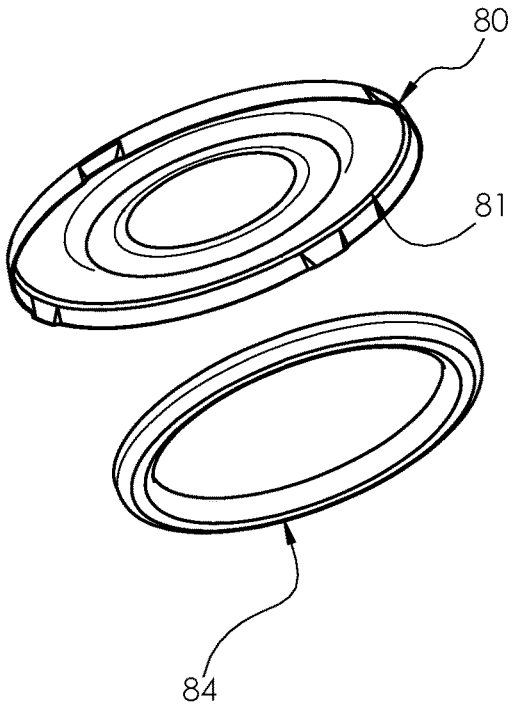
FIG. 5A illustrates a first version of the sealing layer.
Figure 5B:
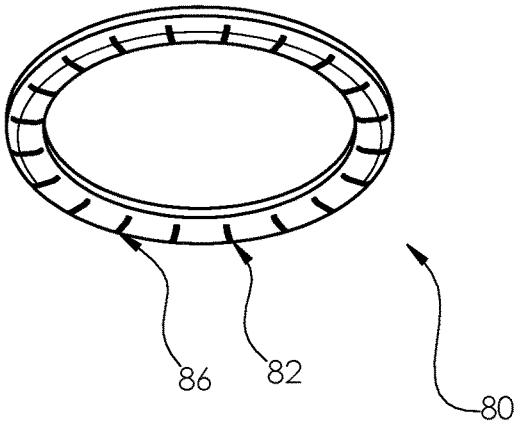
FIG. 5B illustrates a second version of the sealing layer.

It is also understood that the sealable opening 82 may be caused by slits or ribs 86 in the sealing layer 80 (see, FIG. 5*b*), in particular a gasket version, that permits air to escape from the chamber 24. The slits and ribs 86 are adapted to create a hermetic seal when a sufficient, downward force is applied to the sealing layer 80 which should occur just prior to or when an at least one tab 72—extending downwardly, downwardly and inwardly, downwardly and outwardly, or combinations thereof from the outer lid top surface's interior surface 75, 22*d* extending toward the outer lid's proximal end 14*d*—removably connects to the at least one locking protrusion 64 on the inner lid 50.

The storage device 5 also has the outer lid 70. The outer lid 70 has an outer lid top surface 75 at the outer lid distal 16, 16*d*, an outer lid exterior surface 20*d*, an outer lid interior surface 22*d*, and an outer lid side surface 77. The outer lid side surface 77 and the outer lid interior surface 22*d* define an outer lid opening 79. The outer lid opening (i) is at the outer lid's proximal end 14*d*, and (ii) has a radius equal to or, preferably, greater than the inner lid exterior surface's radius on and along the side surface 18*c*, 20*c*. The outer lid interior surface 22*d* and the outer lid exterior surface 20*d* are separated from each other by (a) the material or materials that forms the outer lid exterior surface 20*d* and the outer lid interior surface 22*d*, thus there is no gap between the surfaces 20*d*, 22*d*; (b) by at least one insulation/gap area between the outer lid exterior surface 20*d* and the outer lid interior surface 22*d* that can be a vacuum environment, filled with insulation, or air, or combinations thereof and wherein the outer lid exterior surface 20*d* and the outer lid interior surface 22*d* are normally joined together by an outer lid joinder surface to form at the outer lid proximal end 14*d*, or (c) combinations thereof. The outer lid joinder surface can be made of the same or different material or materials that forms the outer lid exterior surface 20*d* and the outer lid interior surface 22*d*. The materials that form the outer lid 50 are selected from the group consisting of polymeric material, metallic material, and combinations thereof with the understanding that the material used should not contaminate the product contained in the chamber 24 since the outer lid 70 does not have to contact the container in this embodiment.

The outer lid 70 also has at least one tab 72 (*a*) extending downwardly; downwardly and inwardly; downwardly and outwardly; or combinations thereof from the outer lid top surface's interior surface 75, 22*d* that extends toward the outer lid's proximal end 14*d* and (b) is capable of contacting and removably connecting with the at least one locking protrusion 64 on the inner lid 50. The outer lid 70 has at least one sealing extension 76 extending from the outer lid top surface's interior surface 75, 22*d* toward the outer lid's proximal end 14*d* wherein when (i) the outer lid opening 79 receives the inner lid 50, (ii) the inner lid is threadably mated with the container 10, and (iii) the container 10 has the sealing layer 80 positioned over the mouth 12; the sealing extension 76 protrudes through the center aperture 68 and contacts the sealing layer 80 (see FIG. 8) to (a) push a desired amount of air 210 from the chamber 24 when the resealable, lower air pressure receptacle 5 alters from the non-compressed state (FIG. 8) towards the compressed state (FIG. 9); and (b) inhibit air 210 from entering or exiting the chamber 24 when the resealable, lower air pressure receptacle 5 is in the compressed state (see FIG. 10) which occurs when the at least one tab 72 removably connects with the at least one locking protrusion 64.

Figure 11A:
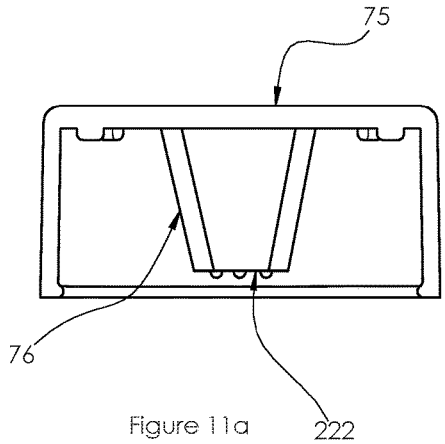
FIG. 11A illustrates a solid truncated conical sealing extension of the outer lid.
Figure 11B:
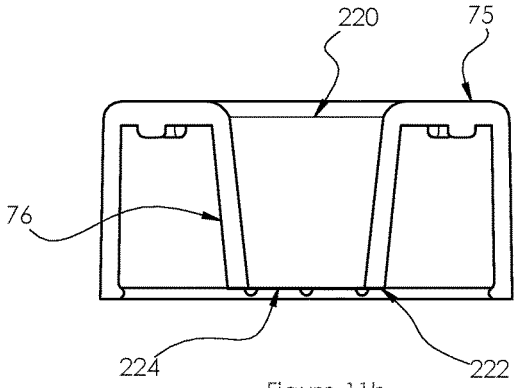
FIG. 11B illustrates a hollowed-center, truncated conical sealing extension.
Figure 11C:
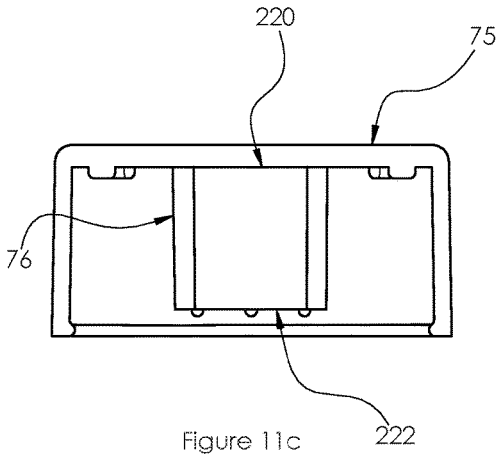
FIG. 11C illustrates a solid cylindrical sealing extension of the outer lid.
Figure 11D:
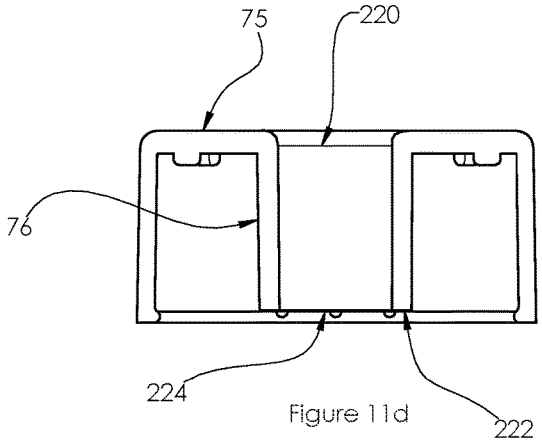
FIG. 11D illustrates a hallowed-center, truncated conical sealing extension.

In another embodiment, the at least one sealing extension 76 can define a viewing opening 220 (see, FIGS. 11*b* and 11*d*) in the outer lid top surface 75. The at least one sealing extension 76 can be cylindrical shape, a truncated conical shape, or combinations thereof on the condition that the at least one sealing extension is able to pass through the central aperture 68 to contact the sealing layer 80. Whichever shape is selected, the at least one sealing extension's proximal end 222 that contacts the sealing layer 80 can (a) be a solid block (see, FIGS. 11*a* and 11*c*) that applies uniform pressure to the sealing layer 80 exposed by the central aperture 68, (b) have at least one contact aperture 224 so that when the at least one sealing extension's proximal end 222 that contacts the sealing layer 80 a user of the storage device 5 can see the exposed sealing layer 80 through the outer lid top surface opening 220 and at least one sealing extension contact aperture 224 (see, FIGS. 11*b* and 11*d*), or (c) combinations thereof.

Alternatively while retaining the above-identified at least one sealing extension structures, the outer lid top surface 75 can be a solid surface with no opening 220. See, FIGS. 11*a* and 11*c*). The outer lid top surface 75 can also be translucent, or transparent to permit a user to see if the storage device 5 is in a vacuum packed state—the compressed state.

Inner Lid Compress

Figure 7:
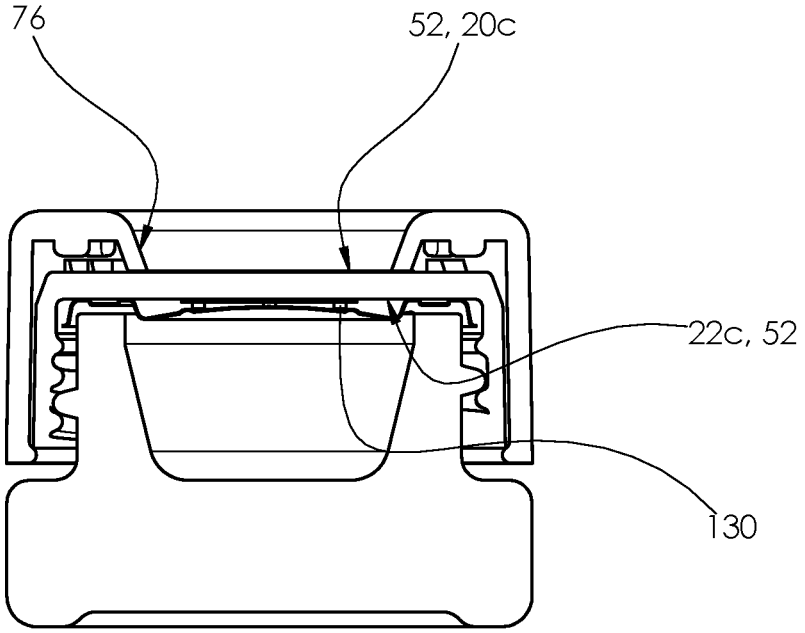
FIG. 7 illustrates an alternative version of the resealable, lower air pressure receptacle.

In another embodiment, the container 10 and the sealing layer 80 are identical to the above-identified embodiment, while the inner lid 50 and the outer lid 70 have been slightly modified to obtain the same results. In particular, the inner lid 50 has the inner lid top surface 52 at the inner lid's distal end 16*c*, the inner lid exterior surface 20*c*, the inner lid interior surface 22*c*, and the inner lid side surface 18*c* wherein the inner lid side surface 18*c* and the inner lid interior surface 22*c* define the inner lid opening 55, and the inner lid opening 55 is positioned at the inner lid proximal end 14*c*. The inner lid interior surface 22*c* and the inner lid exterior surface 20*c* are spaced apart by (a) the material or materials that forms the inner lid exterior surface 20*c* and the inner lid interior surface 22*c*, thus there is no gap between the surfaces 20*c*, 22*c*; (b) by at least one insulation/gap area between the inner lid exterior surface 20*c* and the inner lid interior surface 22*c* that can be a vacuum environment, filled with insulation or air, or combinations thereof and wherein the inner lid exterior surface 20*c* and the inner lid interior surface 22*c* are normally joined together by an inner lid joinder surface to form at the inner lid proximal end 14*c*, or (c) combinations thereof. The inner lid joinder surface can be made of the same or different material or materials that forms the inner lid exterior surface 20*c* and the inner lid interior surface 22*c*. The materials that form the inner lid 50 are selected from the group consisting of polymeric material, metallic material, and combinations thereof with the understanding that the material used must not contaminate the product contained in the chamber 24. In one embodiment, the inner lid 50 has at least one sealing tab 130 extending from the inner lid top surface's interior surface 22*c* toward the inner lid's proximal end 14*c* (see, FIG. 7); the threaded section 60 having threads 62 on the inner lid's interior side surface 22*c*, 18*c*, the inner lid's threaded section 60 is capable of threadably mating and/or being removably attached with the container's threaded exterior surface area 200, and the at least one locking protrusion or lug 64 extending upward from the top surface's exterior surface 52, 20*c*.

To accommodate this inner lid 50 embodiment, the outer lid 70 has the outer lid top surface 75 at the outer lid distal 16, 16*d*, the outer lid exterior surface 20*d*, an outer lid interior surface 22*d*, and the outer lid side surface 77. The outer lid side surface 77 and the outer lid interior surface 22*d* define the outer lid opening 79. The outer lid opening 79 (*i*) is at the outer lid's proximal end 14*d*, and (ii) has a radius equal to or greater than radius of the inner lid exterior surface on the side surface 18*c*, 20*c*. The outer lid interior surface 22*d* and the outer lid exterior surface 20*d* are separated from each other by (a) the material or materials that forms the outer lid exterior surface 20*d* and the outer lid interior surface 22*d*, thus there is no gap between the surfaces 20*d*, 22*d*; (b) by at least one insulation/gap between the outer lid exterior surface 20*d* and the outer lid interior surface 22*d* that can be a vacuum environment, filled with insulation or air, or combinations thereof and wherein the outer lid exterior surface 20*d* and the outer lid interior surface 22*d* are normally joined together by an outer lid joinder surface to form at the outer lid proximal end 14*d*, or (c) combinations thereof. The outer lid joinder surface can be made of the same or different material or materials that forms the outer lid exterior surface 20*d* and the outer lid interior surface 22*d*. The materials that form the outer lid 50 are selected from the group consisting of polymeric material, metallic material, and combinations thereof with the understanding that the material used should not contaminate the product contained in the chamber 24 since the outer lid 70 does not have to contact the container in this embodiment.

The outer lid 70 also has at least one tab 72 (*a*) extending from the outer lid top surface's interior surface 75, 22*d* toward the outer lid's proximal end 14*d* and (b) is capable of contacting and removably locking with the at least one locking protrusion 64 on the inner lid 50. The outer lid 70 has at least one sealing extension 76 extending from the outer lid top surface's interior surface 75, 22*d* toward the outer lid's proximal end 14*d* wherein when (i) the outer lid opening 79 receives the inner lid 50, (ii) the inner lid is threadably mated with the container, and (iii) the container has the sealing layer 80 positioned over the mouth 12; the sealing extension 76 contacts the inner lid top and exterior surface 52, 20*c* (see, FIG. 7) and that causes the at least one sealing tab 130 to contact the sealing layer 80 to (a) push a desired amount of air 210 from the chamber 24 when the resealable, lower air pressure receptacle 5 alters from the non-compressed state (similar to that shown at FIG. 8) towards the compressed state (similar to that shown at FIG. 9); and (b) inhibit air 210 from entering or exiting the chamber 24 when the resealable, lower air pressure receptacle 5 is in the compressed state (similar to that shown at FIG. 10) which occurs when the at least one tab 72 removably connects with the at least one locking protrusion 64.

When the outer lid interior top surface 75, 22*d* approaches the inner lid exterior top surface 52, 20*c*, the at least one complimentary locking lug 72 and the at least one locking lug 64 can contact and/or align with each other during each sealing step that entails the outer lid 70 being removably attached to the storage device 5 to create the initial vacuum seal in the storage device 5. The phrase "removably attached" means the outer lid 70 can be attached to and removed from the storage device 5 and the inner lid 50 many times. Likewise, the inner lid 50 can be removably attached to the container 10 many times. The outer lid 70 is removably attached to the storage device 5 and the inner lid 50 by applying a downward and sufficient torque force to align, contact and removably connect the at least one complimentary locking lug 72 and the at least one locking lug 64.

Figure 6:
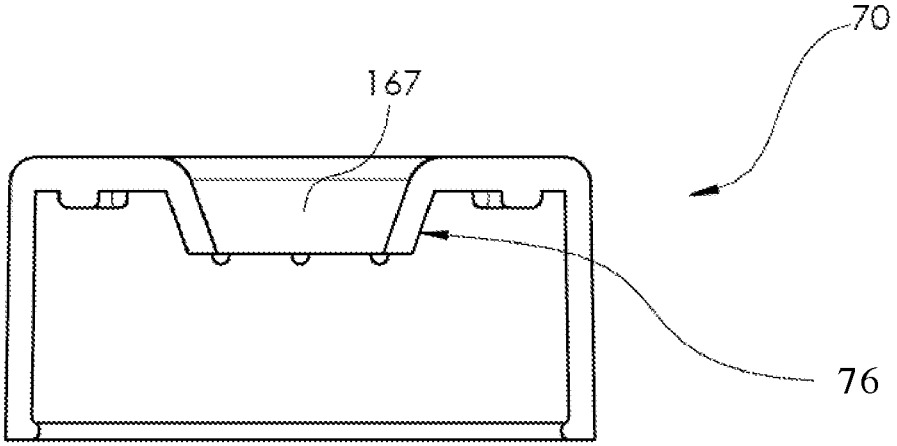
FIG. 6 illustrates a second version of the outer lid.

As a reminder, the inner cap 50 has the top section 52. In one embodiment, the inner cap's top section 52 has a top surface aperture 68 that exposes a portion of the sealing layer 80. Likewise, the outer cap 70 has the top surface 75 and the top surface has a sealing extension 76 extending downward (cylindrical shape) as shown in FIG. 6 or downwardly and inwardly (truncated conical shape) as shown in FIG. 3. The sealing extension 76 is capable of being positioned to enter the top surface aperture 68 and apply pressure to the sealing layer 80. The sealing extension 76 can define a seal cavity 220 in the top surface 75 to expose the sealing layer 80 to an ambient environment when the storage device 5 has a vacuum environment in the container's chamber 24. Alternatively, the top surface 75 can be a solid material without the seal cavity 220 in order for the sealing extension 76 to extend downward and/or downwardly and inwardly from the interior top surface 170.

Creating the vacuum environment in the container's chamber 24 is illustrated in FIGS. 8 and 9. FIG. 8 illustrates a non-compressed state 402 of the storage device 5 having the container 10, the sealing layer 80, the inner cap 50 and the outer cap 70 wherein the sealing extension 76 is able to contact the sealing layer 80. FIG. 9 illustrates a beginning step toward a compressed state 404*a* of the storage device 5 when the outer cap 70 moves downward (torqued, pushed, screwed down, or combinations thereof) toward the container 10 and that causes (a) the at least one complimentary locking lug 72 and the at least one locking lug 64 to contact each other and (b) the outer cap's sealing extension 76 applies pressure to the sealing layer 80 in order to push air 210 from the container's chamber 24 through the opening 200 between the sealing layer 80 and the container's distal end 16. Once the outer cap 70 can no longer be moved downward toward the container 10, the storage device 5 is in the final step of the compressed state 404*b* (as illustrated at FIG. 10) wherein the openings are closed and a desired quantity of air was directed from the chamber 24 to the ambient environment to create the vacuum environment in the chamber 24; and the sealing layer 80 has a convex shape.

Each storage device 5 is designed to alter, numerous times, from the non-compressed state 402 to the compressed state 404*b*, and from the compressed state 404*b* to the non-compressed state 402 while being able to create the desired vacuum state in the chamber 24 each time the storage device 5 is changed to the compressed state 404*b*.

Once the storage device 5 is released from the compressed state, when the sealing extension 76 or the at least one sealing tab 130 does not contact the sealing layer 80, and the storage device 5 permits air to enter the chamber 24, then the storage device 5 creates a vacuum pop to indicate the vacuum seal has been broken.

Vacuum State Alterations

Figure 12:
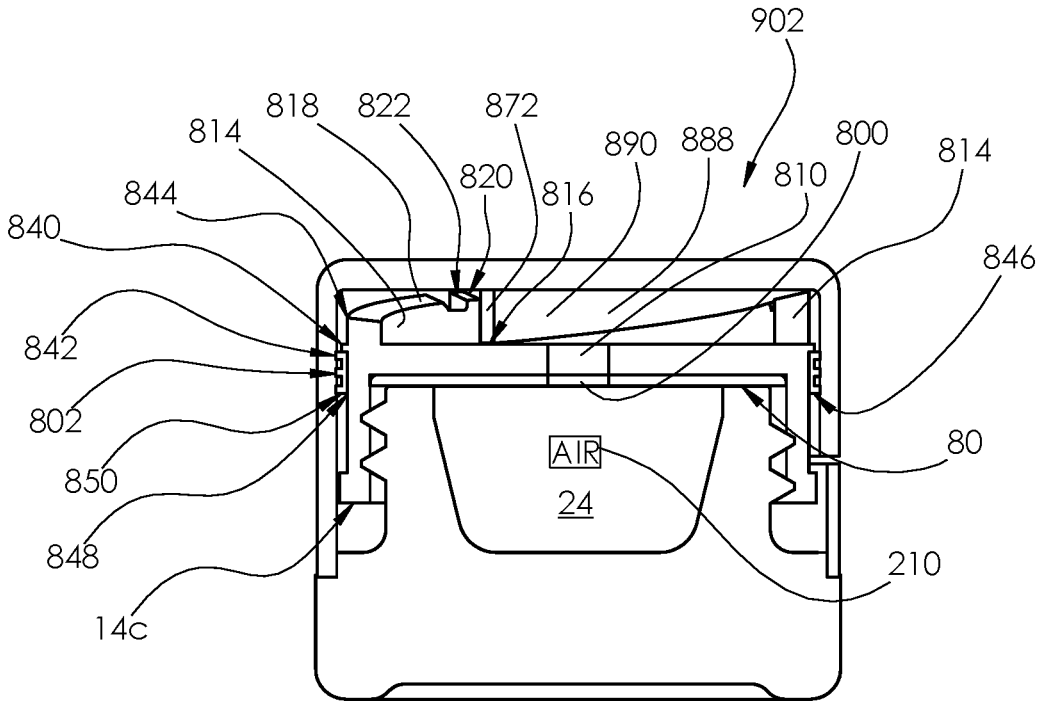
FIG. 12 illustrates a non-vacuum state for the resealable, lower air pressure receptacle.

In another alternative embodiment, the resealable, lower air pressure receptacle 5 has the identical container as the above-identified containers 10. The sealing layer 80 is the same material and is positioned between the mouth 12 and the inner lid 50 in the exact same way as the above-identified sealing layers 80. The only difference between the sealing layers 80, is that in this embodiment the sealing layer 80 has a seal-air aperture 800 above the chamber 24 as shown in FIG. 12. The seal-air aperture 800 extends from the sealing layer distal end 16*b* to the sealing layer proximal end 14*b*.

The inner lid 50 has the inner lid top surface 52 at the inner lid's distal end 16*c*, an inner lid exterior surface 20*c*, an inner lid interior surface 22*c*, and an inner lid side surface 18*c* wherein the inner lid side surface 18*c* and the inner lid interior surface 22*c* define an inner lid opening 55, and the inner lid opening 55 is positioned at the inner lid proximal end 14*c*.

Figure 13:
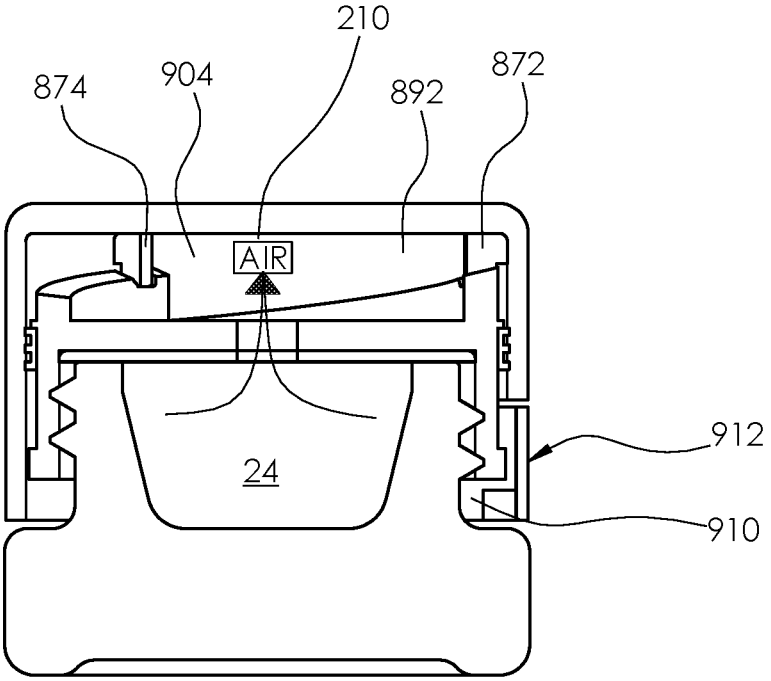
FIG. 13 illustrates a vacuum state for the resealable, lower air pressure receptacle.

A seal gasket 802 is also positioned on the inner lid exterior side surface 18*c*, 20*c*. The seal gasket 802 is capable of creating a hermetic seal between the inner lid exterior side surface 18*c*, 20*d*, and the outer lid interior side surface 77, 22*d*. To decrease the chance that the seal gasket 802 will move, a gasket protrusion 840 can be positioned between the seal gasket's distal end 842 and the inner lid's distal end 844. In most instances, the gasket protrusion 840 is positioned adjacent to the gasket's distal end 842 as shown at FIGS. 12 and 13.

Optionally, a second gasket protrusion 846 can be positioned between the seal gasket's proximal end 848 and the inner lid's proximal end 14*c*. In most instances, the second gasket protrusion 846 is positioned adjacent to the seal gasket's proximal end 850 as shown at FIGS. 12 and 13.

Figure 14:
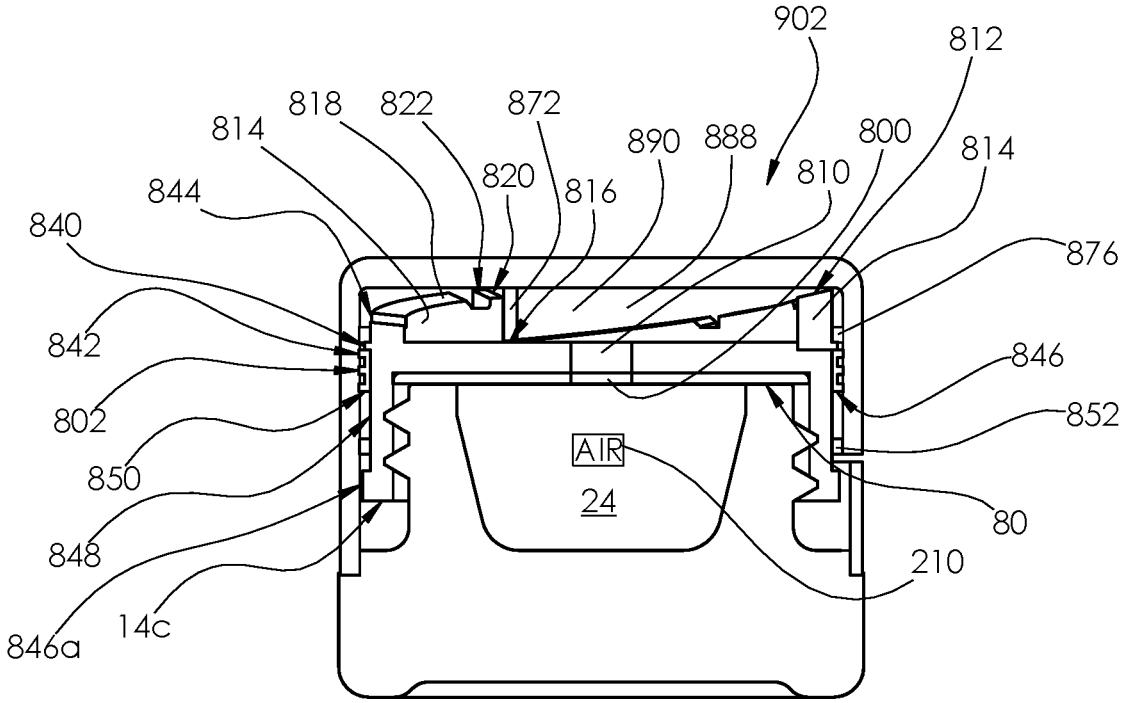
FIG. 14 illustrates an alternative embodiment of FIG. 12.
Figure 15:
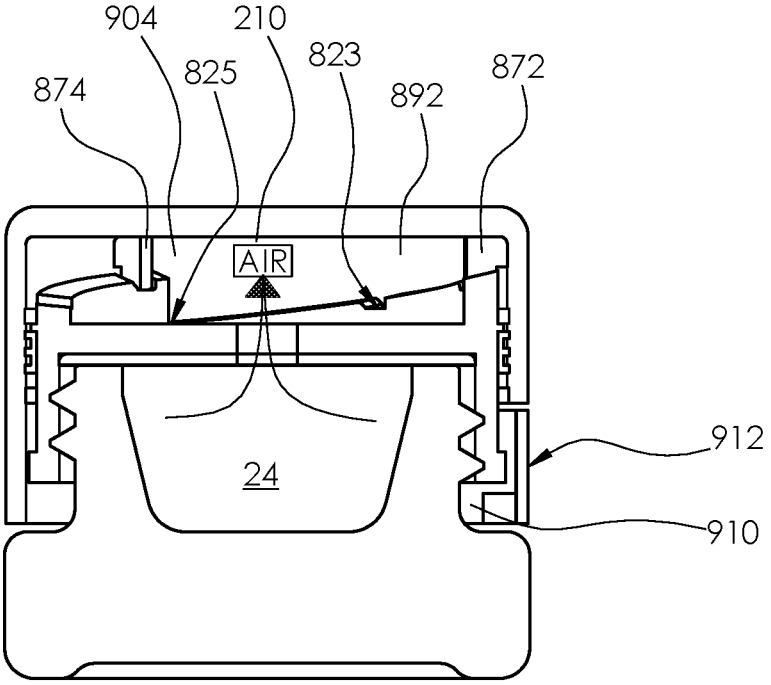
FIG. 15 illustrates an alternative embodiment of FIG. 13.

Optionally, a second seal gasket 852 can be positioned between the seal gasket's proximal end 848 and the inner lid's proximal end 14*c*. In most instances, the second seal gasket 852 is positioned adjacent to the gasket's proximal end 850 as shown at FIGS. 14 and 15.

Optionally, a second gasket protrusion 846*a* can be positioned between the second seal gasket's proximal end 848*a* and the inner lid's proximal end 14*c*. In most instances, the second gasket protrusion 846*a* is positioned adjacent to the second seal gasket's proximal end as shown at FIGS. 14 and 15.

The inner lid interior surface 22*c* and the inner lid exterior surface 20*c* are spaced apart by (a) the material or materials that forms the inner lid exterior surface 20*c* and the inner lid interior surface 22*c*, thus there is no gap between the surfaces 20*c*, 22*c*; (b) by at least one insulation/gap area between the inner lid exterior surface 20*c* and the inner lid interior surface 22*c* that can be a vacuum environment, filled with insulation or air, or combinations thereof and wherein the inner lid exterior surface 20*c* and the inner lid interior surface 22*c* are normally joined together by an inner lid joinder surface to form at the inner lid proximal end 14*c*, or (c) combinations thereof. The inner lid joinder surface can be made of the same or different material or materials that forms the inner lid exterior surface 20*c* and the inner lid interior surface 22*c*. The materials that form the inner lid 50 are selected from the group consisting of polymeric material, metallic material, and combinations thereof with the understanding that the material used must not contaminate the product contained in the chamber 24. In one embodiment, the inner lid 50 has an air-release aperture 810 on the inner lid top surface 52 wherein the air-release aperture 810 extends from the inner lid's exterior surface 20*c* to the inner lid's interior surface 22*c*.

The air-release aperture 810 and the seal-air aperture 800 can be aligned as illustrated in FIG. 12, misaligned with some overlap between the seal-air aperture 800 and the air-release aperture 810, or misaligned.

The inner lid 50 also has the threaded section 60 having threads 62 on the inner lid's interior side surface 22*c*, 18*c*, the inner lid's threaded section 60 is capable of threadably mating to and/or being removably attached with the container's threaded exterior surface area 200, and at at least a first arc-shaped ramp 812 and a second arc-shaped ramp 814 positioned on and extending upward from the inner lid's top exterior surface 52, 20*c*. The first arc-shaped ramp and the second arc-shaped ramp each has (i) a base area 816, (ii) an inclined area 818 that extends from the base area 816 to an apex 820 and (iii) a first releasable locking notch 822. The first releasable locking notch 822 is positioned at or near each ramp's apex 820.

Optionally, the first arc-shaped ramp and the second arc-shaped ramp each can have a middle releasable locking notch 823 positioned between the at least one releasable locking notch 822 and the base area 816 on the inclined area 818.

Optionally, the base area 822 can have a base releasable locking notch 825 positioned in the base area 816 to ensure the respective tabs do not move until a user wants the tabs to be moved.

The outer lid 70 has the outer lid top surface 75 at the outer lid distal 16, 16*d*, the outer lid exterior surface 20*d*, the outer lid interior surface 22*d*, and the outer lid side surface 77. The outer lid side surface 77 and the outer lid interior surface 22*d* define the outer lid opening 79. The outer lid opening (i) is at the outer lid's proximal end 14*d*, and (ii) has a radius equal to or greater than radius of the inner lid exterior surface on the side surface 18*c*, 20*c*. The outer lid interior surface 22*d* and the outer lid exterior surface 20*d* are separated from each other by (a) the material or materials that forms the outer lid exterior surface 20*d* and the outer lid interior surface 22*d*, thus there is no gap between the surfaces 20*d*, 22*d*; (b) by at least one insulation/gap area between the outer lid exterior surface 20*d* and the outer lid interior surface 22*d* that can be a vacuum environment, filled with insulation or air, or combinations thereof and wherein the outer lid exterior surface 20*d* and the outer lid interior surface 22*d* are normally joined together by an outer lid joinder surface to form at the outer lid proximal end 14*d*, or (c) combinations thereof. The outer lid joinder surface can be made of the same or different material or materials that forms the outer lid exterior surface 20*d* and the outer lid interior surface 22*d*. The materials that form the outer lid 50 are selected from the group consisting of polymeric material, metallic material, and combinations thereof with the understanding that the material used should not contaminate the product contained in the chamber 24 since the outer lid 70 does not have to contact the container in this embodiment.

The outer lid 70 also has at least a first vacuum-air tab 872 and a second vacuum-air tab 874. Each vacuum-air tab 872, 874 (*a*) extends from the outer lid top surface's interior surface 75, 22*d* toward the outer lid's proximal end 14*d* a predetermined distance to create a lower air pressure in the storage device 5. The outer lid 70 is capable of hermetically mating with the inner lid exterior side surface 18*c*, 20*c* by having at least a portion of the outer lid interior side surface 77, 22*d* contact the gasket 802. Optionally, the outer lid interior side surface 77, 22*d* can have an outer gasket 876 positioned thereon to contact (a) the seal gasket 802, the second seal gasket 852, and/or (b) the inner lid exterior side surface 18*c*, 20*c* that is between (i) the seal gasket's proximal end 848 and the inner lid's proximal end 14*c* to increase the hermetic seal between the outer lid 70 and the inner lid 50.

Creating the vacuum environment in the container's chamber 24 is illustrated at FIGS. 12 and 13. FIG. 12 illustrates a non-vacuum state 902 of the storage device 5 having the container 10, the sealing layer 80, the inner lid 50 and the outer lid 70 interconnected and the inner lid 50 hermetically sealed to the outer lid 70; which means the first vacuum-air tab 872 from the outer lid 70 is positioned at or near the base area 816 of the first arc-shaped ramp 812 and the second vacuum-air tab 874 from the outer lid 70 is positioned at or near the base area 816 of the second arc-shaped ramp 814 to maintain atmospheric pressure state in the chamber 24 when the outer lid 70 was positioned over the inner lid 50 as shown in FIGS. 12 and 14. The area between the inner lid top and exterior surface 52, 20*c* and the outer lid top and interior surface 75, 22*d* in the non-vacuum state 902 is referred to as the normal pressure chamber 890.

To create the vacuum environment state 904 in the storage device 5, the outer lid 70 is turned relative to the inner lid 50 so the first and second vacuum-air tabs 872, 874 each move along their respective ramp from the base area 816 toward the apex 820 and into the releasable locking notch 820. That movement alters the normal pressure chamber 890 to a lower pressure chamber 892 because that movement of the vacuum-air tabs 872, 874 from the base area 816 to the releasable locking notch 820 (*a*) increases the distance between the inner lid top and exterior surface 52, 20*c* and the outer lid top and interior surface 75, 22*d* and (b) pulls the air 210 from the chamber 24 through the apertures 800, 810 into the lower pressure chamber 892 in order to create a lower atmospheric pressure state in the chamber 24 and the storage device 5.

Each embodiment of the invention can also have a releasable child-resistance notch 910 on the container 10 and a releasable child-resistance tab 912 on the outer lid 70. The releasable child-resistance notch and the releasable child-resistance tab are capable of mating when the outer lid 70 is properly attached to the container 10 so that a user of the storage device 5 must apply a sufficient force to open the storage device 5. That sufficient force is designed to inhibit young children from being capable of opening it.

It will be understood that well known processes have not been described in detail and have been omitted for brevity. Although specific steps, structures and materials may have been described, the present disclosure may not be limited to these specifics, and others may substitute as is well understood by those skilled in the art, and various steps may not necessarily be performed in the sequences shown.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The invention claimed is:

1. A resealable, lower air pressure receptacle comprising:

(A) a container having
- (a) a base surface at a proximal end of the container;
- (b) at least one side surface extending upward from the base surface toward a distal end of the container,
- (c) the base surface and the at least one side surface define a container exterior surface and a container interior surface; the container exterior surface and the container interior surface are spaced apart;
- (d) a mouth positioned at the distal end of the at last one side surface and defines an opening of a chamber defined by the container interior surface, the chamber is capable of receiving air and/or at least one object,
- (e) a container threaded exterior surface area on the container exterior surface;

(B) a sealing layer capable of being positioned over the mouth and the chamber, and having a sealable opening positioned between the sealing layer and the mouth to (a) permit air to escape from the chamber when the resealable, lower air pressure receptacle is in a non-compressed state and converting toward a compressed state; and (b) inhibit air from entering the chamber when the resealable, lower air pressure receptacle is in the compressed state;

(C) an inner lid having:
- (a) an inner lid top surface at a distal end of the inner lid,
- (b) an inner lid exterior surface,
- (c) an inner lid interior surface, the inner lid interior surface and the inner lid exterior surface are spaced apart,
- (d) an inner lid side surface, the inner lid side surface and the inner lid interior surface define an inner lid opening, the inner lid opening is positioned at a proximal end of the inner lid,
- (e) a center aperture on the inner lid's top surface wherein the center aperture extends from the inner lid's exterior surface to the inner lids interior surface,
- (f) a threaded section on the inner lid's interior side surface, the inner lid's threaded section capable of threadably mating with the container's threaded exterior surface area, and (g) at least one locking protrusion extending upward from the top surface's exterior surface; and (D) an outer lid having (a) an outer lid top surface at a distal end of the outer lid, (b) an outer lid exterior surface, (c) an outer lid interior surface, the outer lid interior surface is separated from the outer lid exterior surface, (d) an outer lid side surface, the outer lid side surface and the outer lid interior surface define an outer lid opening, the outer lid opening (i) is at the proximal end of the outer lid, and (ii) has a radius equal to or greater than radius of the inner lid exterior surface, (e) at least one tab (a) extending from the outer lid top surface's interior surface toward the outer lid's proximal end and (b) is capable of contacting and removably locking with the at least one locking protrusion, (f) at least one sealing extension extending from the outer lid top surface's interior surface toward the outer lid's proximal end;

wherein when (i) the outer lid opening receives the inner lid, (ii) the inner lid is threadably mated with the container, and (iii) the container has the sealing layer positioned over the mouth; the sealing extension protrudes through the center aperture and contacts the sealing layer to (a) push a desired amount of air from the chamber when the resealable, lower air pressure receptacle alters from the non-compressed state towards the compressed state; and (b) inhibit air from entering or exiting the chamber when the resealable, lower air pressure receptacle is in the compressed state which occurs when the at least one tab removably locks with the at least one locking protrusion.

2. A resealable, lower air pressure receptacle comprising:

(A) a container having (a) a base surface at a proximal end of the container;

(b) at least one side surface extending upward from the base surface toward a distal end of the container, (c) the base surface and the at least one side surface has define a container exterior surface and a container interior surface; the container exterior surface and the container interior surface are spaced apart;

(d) a mouth positioned at the distal end of the at last one side surface and defines an opening of a chamber defined by the container interior surface, the chamber is capable of receiving air and/or at least one object, (e) a container threaded exterior surface area on the container exterior surface;

(B) a sealing layer capable of being positioned over the mouth and the chamber, and having a sealable opening positioned between the sealing layer and the mouth to (a) permit air to escape from the chamber when the resealable, lower air pressure receptacle is in a non-compressed state and converting toward a compressed state; and (b) inhibit air from entering the chamber when the resealable, lower air pressure receptacle is in the compressed state;

(C) an inner lid having:

(a) an inner lid top surface at a distal end of the inner lid, (b) an inner lid exterior surface, (c) an inner lid interior surface, the inner lid interior surface and the inner lid exterior surface are spaced apart, (d) an inner lid side surface, the inner lid side surface and the inner lid interior surface define an inner lid opening, the inner lid opening is positioned at a proximal end of the inner lid, (e) at least one sealing tab extending from the inner lid top surface's interior surface toward the inner lid's proximal end, (f) a threaded section on the inner lid's interior side surface, the inner lid's threaded section capable of threadably mating with the container's threaded exterior surface area, and (g) at least one locking protrusion extending upward from the top surface's exterior surface; and (D) an outer lid having (a) an outer lid top surface at a distal end of the outer lid, (b) an outer lid exterior surface, (c) an outer lid interior surface, the outer lid interior surface is separated from the outer lid exterior surface, (d) an outer lid side surface, the outer lid side surface and the outer lid interior surface define an outer lid opening, the outer lid opening (i) is at the proximal end of the outer lid, and (ii) has a radius equal to or greater than radius of the inner lid exterior surface, (e) at least one tab (a) extending from the outer lid top surface's interior surface toward the outer lid's proximal end and (b) is capable of contacting and removably locking with the at least one locking protrusion, (f) at least one sealing extension extending from the outer lid top surface's interior surface toward the outer lid's proximal end;

wherein when (i) the outer lid opening receives the inner lid, (ii) the inner lid is threadably mated with the container, and (iii) the container has the sealing layer positioned over the mouth; the sealing extension contacts the inner lid top surface and that causes the at least one sealing tab to contact the sealing layer to (a) push a desired amount of air from the chamber when the resealable, lower air pressure receptacle alters from the non-compressed state towards the compressed state; and (b) inhibit air from entering or exiting the chamber when the resealable, lower air pressure receptacle is in the compressed state which occurs when the at least one tab removably locks with the at least one locking protrusion.

3. A resealable, lower air pressure receptacle comprising:

(A) a container having (a) a base surface at a proximal end of the container;

(b) at least one side surface extending upward from the base surface toward a distal end of the container, (c) the base surface and the at least one side surface define a container exterior surface and a container interior surface; the container exterior surface and the container interior surface are spaced apart;

(d) a mouth positioned at the distal end of the at last one side surface and defines an opening of a chamber defined by the container interior surface, the chamber is capable of receiving air and/or at least one object, (e) a container threaded exterior surface area on the container exterior surface;

(B) a sealing layer capable of being positioned over the mouth and the chamber, and having an aperture positioned over the chamber;

(C) an inner lid having:

(a) an inner lid top surface at a distal end of the inner lid, (b) an inner lid exterior surface, (c) an inner lid interior surface, the inner lid interior surface and the inner lid exterior surface are spaced apart, (d) an inner lid side surface, the inner lid side surface and the inner lid interior surface define an inner lid opening, the inner lid opening is positioned at a proximal end of the inner lid, (e) an inner lid aperture on the inner lid's top surface wherein the inner lid aperture extends from the inner lid's exterior surface to the inner lid's interior surface, (f) a threaded section on the inner lid's interior side surface, the inner lid's threaded section capable of threadably and hermetically mating with the container's threaded exterior surface area, (g) a gasket positioned on the inner lid exterior side surface, and (h) at least a first arc-shaped ramp and a second arc-shaped ramp positioned on the inner lid's top exterior surface; the first arc-shaped ramp and the second arc-shaped ramp each has (i) a base area, (ii) an inclined area that extends from the base area to an apex and (iii) at least one locking notch, the at least one locking notch is positioned at or near each ramp's apex, and (D) an outer lid having (a) an outer lid top surface at a distal end of the outer lid, (b) an outer lid exterior surface, (c) an outer lid interior surface, the outer lid interior surface is separated from the outer lid exterior surface, (d) an outer lid side surface, the outer lid side surface and the outer lid interior surface define an outer lid opening, the outer lid opening (i) is at the proximal end of the outer lid, and (ii) has a radius equal to or greater than radius of the inner lid exterior surface that is capable of hermetically sealing to the inner lid exterior surface through the gasket, (e) at least a first tab and a second tab (a) extending from the outer lid top surface's interior surface toward the outer lid's proximal end and (b) is capable of contacting and removably locking with the at least one locking protrusion;

wherein when (i) the outer lid opening receives the inner lid, (ii) the inner lid is threadably mated with the container, (iii) the container has the sealing layer positioned over the mouth; (A) each tab is capable of being positioned at or near the base area to maintain an ambient atmospheric state in the chamber; and (B) the outer lid is capable of being rotated so each tab moves from the base area toward the apex along the inclined area and into the locking notch to create a lower atmospheric pressure state in the chamber.

4. The resealable, lower air pressure receptacle of claim 3, wherein the aperture and the inner lid aperture are aligned together.

5. The resealable, lower air pressure receptacle of claim 3, wherein the aperture and the inner lid aperture do not align together.

6. The resealable, lower air pressure receptacle of claim 3 wherein the aperture and the inner lid aperture are misaligned with some overlap of the aperture and the inner lid aperture.

7. The resealable, lower air pressure receptacle of claim 3, wherein the inner lid has a block protrusion extending outward from the inner lid's exterior side surface, the block protrusion is positioned between the gasket and the inner lid's distal end.

8. The resealable, lower air pressure receptacle of claim 7, wherein the inner lid has a second block protrusion extending outward from the inner lid's exterior side surface, the second block protrusion is positioned between the gasket and the inner lid's proximal end.

9. The resealable, lower air pressure receptacle of claim 1, wherein the inner lid has a second gasket positioned between the gasket and the inner lid's distal end.

10. The resealable, lower air pressure receptacle of claim 9, wherein the inner lid has a second block protrusion extending outward from the inner lid's exterior side surface, the second block protrusion is positioned between the second gasket and the inner lid's distal end.

11. The resealable, lower air pressure receptacle of claim 3, wherein the outer lid has an outer lid gasket positioned on the outer lid's interior side surface positioned between the outer lid's proximal end and the outer lid's distal end.

12. The resealable, lower air pressure receptacle of claim 11, wherein the outer gasket is capable of contacting the gasket.

13. The reseal able, lower air pressure receptacle of claim 9, wherein the outer lid has an outer lid gasket positioned on the outer lid's interior side surface positioned between the outer lid's proximal end and the outer lid's distal end; and the outer lid gasket is capable of contacting the second gasket.

14. The resealable, lower air pressure receptacle of claim 11, wherein the outer lid has an outer block protrusion extending outward from the outer lids interior side surface, the outer block protrusion is positioned between the outer lid gasket and the outer lid's distal end.

15. The resealable, lower air pressure receptacle of claim 3, wherein the chamber contains at least one pharmaceutical product or at least one food product.

16. The resealable, lower air pressure receptacle of claim 15, wherein the at least one pharmaceutical product or at least one food product is a liquid and/or a colloid.

17. The resealable, lower air pressure receptacle of claim 3, wherein the first arc-shaped ramp and the second arc-shaped ramp each have at least one middle locking notch, the at least one middle locking notch is positioned on the inclined area between the locking notch and the base area.

18. The resealable, lower air pressure receptacle of claim 1 wherein the container has a child-resistance notch and the outer lid has a child-resistance tab: wherein the child-resistance notch and the child-resistance tab are capable of mating when the outer lid is securely attached to the container.

* * * * *